US006291011B1

(12) United States Patent
Edlund

(10) Patent No.: US 6,291,011 B1
(45) Date of Patent: Sep. 18, 2001

(54) DESIGN EFFECT FIBERGLASS WALLCOVERINGS

(75) Inventor: Per Edlund, Halmstad (SE)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/442,170

(22) Filed: Nov. 16, 1999

(51) Int. Cl.[7] ..... B05D 1/38; B05D 5/06

(52) U.S. Cl. ..... 427/178; 427/261; 427/262; 427/287; 427/407.3; 427/355; 427/359

(58) Field of Search ..... 427/407.1, 407.2, 427/407.3, 177, 178, 261, 262, 287, 355, 359

(56) References Cited

U.S. PATENT DOCUMENTS

| | | | |
|---|---|---|---|
| 2,539,329 | | 1/1951 | Sanders . |
| 2,656,327 | | 10/1953 | Wirt et al. . |
| 2,955,053 | | 10/1960 | Roth . |
| 2,961,344 | | 11/1960 | Hurd et al. . |
| 3,108,897 | | 10/1963 | Hamiter et al. . |
| 3,494,782 | * | 2/1970 | Clark et al. . |
| 3,589,934 | | 6/1971 | Schimmel . |
| 3,591,408 | | 7/1971 | Marzocchi . |
| 3,717,500 | | 2/1973 | Mastrianni . |
| 4,112,174 | | 9/1978 | Hannes et al. . |
| 4,495,012 | | 1/1985 | Berenger . |
| 4,619,854 | * | 10/1986 | Penttinen ..... 427/407.3 |
| 4,681,802 | | 7/1987 | Gaa et al. . |
| 4,810,576 | | 3/1989 | Gaa et al. . |
| 5,545,441 | | 8/1996 | Land . |

FOREIGN PATENT DOCUMENTS

| | | |
|---|---|---|
| 0909850 | 10/1998 | (EP) . |
| 732421 | 6/1955 | (GB) . |
| 1270119 | 4/1972 | (GB) . |
| 1288405 | 9/1972 | (GB) . |
| 2249994 | 5/1992 | (GB) . |

* cited by examiner

*Primary Examiner*—Erma Cameron
(74) *Attorney, Agent, or Firm*—Robert D. Touslee

(57) ABSTRACT

A glass fiber wallcovering is made by sequential application of hydrophilic and hydrophobic agents to selectively create an image for painted effects.

16 Claims, 1 Drawing Sheet

DESIGN EFFECT FIBERGLASS WALLCOVERINGS

BACKGROUND

The benefits of using fiberglass wallcoverings are well known. Typically, following adherence of the fiberglass wallcovering to a structure, a uniform coating of a solid paint is applied, creating a textured painted wall effect. Recently, it has become increasing desired to conveniently obtain finished effects different from a solid painted surface. In the absence of using a textured wallcovering such as fiberglass fabric, many consumers are opting for a multi-step "effect paint" finish for interior walls. Such painted effects often comprise a multiple coating of paints, together with labor intensive steps which may include specialized rollers, sponges, devices, with accompanying complex techniques. Typically, only the most experienced or professional painter will achieve a desirable outcome.

In the past, attempts have been made to create color on fiberglass fabrics. GB 2 249 994 A describes applying a colored pattern by a heated roller to a glass fiber fabric treated with a polyvinyl chloride, acrylic or polyester coating having a solids content of between 6 and 35% by weight of dry extracts. The outcome of the process produced a finished glass fabric with a fixed image. Typically, the hot transfer of colored pigments onto a glass fabric at a temperature of between 140° and 210° C. creates a rigid and stiff fabric, not conducive to packaging as a rolled good for later application to a wall.

By reason of the chemical inertness of the base glass material, dyeing techniques are ineffective on such materials. Accordingly, others have attempted prime coated glass textile fiber or fabric with various adherent coatings which are capable of receiving dye substances. U.S. Pat. No. 3,589,934 discloses such a process where glass fibers or fabrics are coated with an interpolymer comprising a non-rubbery interpolymer of a polyunsaturated hydrocarbon monomer and at least one monoolefin monomer having a single copolymerizable ethylenic group. The prime coating is first cured and then the coated fabric is contacted with an organic dye. U.S. Pat. No. 3,591,408 discloses a process for coloring glass fibers and fabrics wherein the glass fibers are treated with the combination of an amino and/or epoxy silane, its silanol or polysiloxane and a fiber reactive "Procilan" dye or "Procion" dye having groupings that react with the amino or epoxy groups of the organo silicon compound to form an organo silicon compound to form an organo silicon-dye compound that becomes strongly anchored to the glass fiber surfaces with sufficient dye concentration to impart the desired color intensity.

U.S. Pat. No. 2,955,053 issued Oct. 4, 1960 to Roth describes a finished wallcovering product. The patent describes a process for first applying a binder in a first treatment bath, followed by one or more coloring baths having pigments contained therein. While providing a colored glass fabric, there is no provision for an effect image. Similarly, GB 1 270 119 and GB 1 288 475 describe coloring of glass fiber fabrics.

U.S. Pat. No. 5,545,441 describes processes for creating colored glass yarns for subsequent use in producing woven glass fabrics having color.

U.S. Pat. No. 3,717,500 describes a process for selectively coloring textured and non-textured yarns of a multiyarn glass fabric.

EP 0 909 850 A2 describes an imprintable self-adhesive woven glass fabric and a process for applying a thin film of adhesive which may carry a decorative pattern directly on the untreated glass fiber fabric.

It is much desired in the art to provide a feasible and economic process to produce an intermediate rolled good product, which when applied to a wall and painted by a consumer, will display a distinct and decorative image effect.

SUMMARY OF THE INVENTION

It is accordingly an object of the present invention to provide a glass yarn fabric product suitable for subsequent application to walls or structures, which fabric is coated and conditioned such that later application of a finished coating or paint results in a desired and selective image effect.

It is another object of the present invention to provide a process for the manufacture of a glass fiber product which process is relatively safe and practical, to produce a designed image fiberglass wallcovering.

According to a preferred embodiment of the present invention, a glass fabric is produced by a process comprising the steps of providing a fiberglass fabric, applying a hydrophilic agent to the glass fabric, selectively applying a hydrophobic secondary image coating to a portion of the treated glass fabric, and drying the treated glass fabric.

While the preferred embodiment utilizes fiberglass fabric in woven rolled form, other fiberglass fabrics such as a nonwoven mat may be used.

Still other objects, features and attendant advantages of the present invention would become apparent to those skilled in the art upon reading the following detailed description of the preferred embodiments, together with the accompanying drawings.

DETAILED DESCRIPTION OF THE INVENTION

Figure 1:
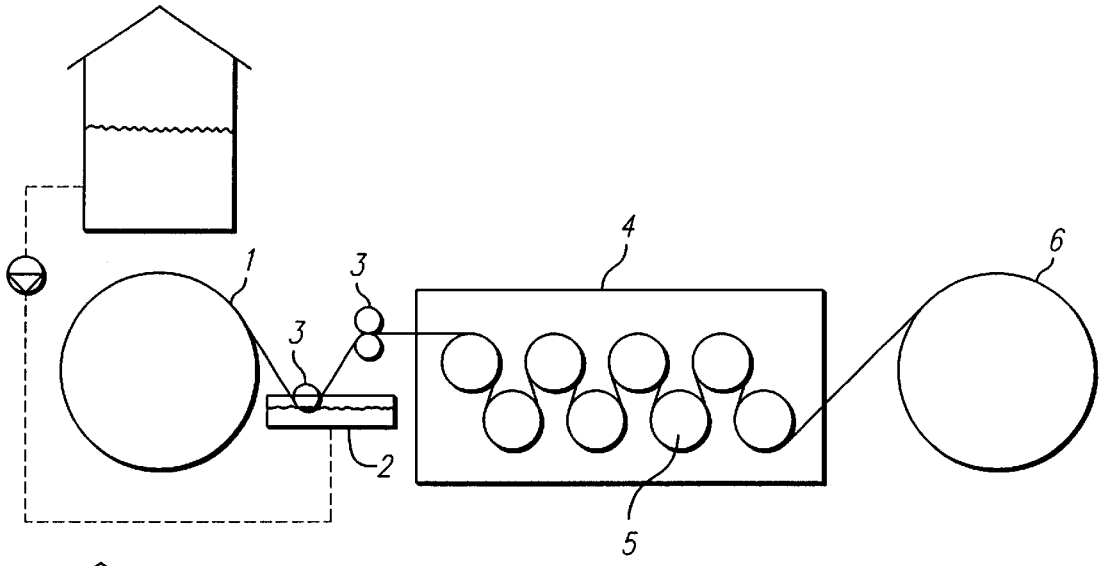
FIG. 1 depicts the process for applying the hydrophilic agent, in the preferred method of continuous impregnation.

FIG. 1 depicts a process for applying a first coating to a glass fabric, preferably, the glass fabric is a woven product from fiberglass yarn. The weave is typically a simple pattern, of up to eight shaft. The weave is produced, for example, on Dornier weaving machines, Rapiers or Air-Jets, in typically two to three meter widths for collecting on roll beams of typically 1,500–6,000 meters of untreated woven fiberglass fabric. Many fiberglass yarns are possible for use in producing the woven material for use in the present invention. Preferred yarns include, for the warp direction continuous c-glass or e-glass of 9–10 microns, 139–142 texturized with approximately 315–340 ends per meter. An alternative warp yarn is continuous c-glass or e-glass of 6–9 micron, 34–68 tex with 680 ends per meter. For the weft direction, a preferred glass is discontinuous spun e-glass or c-glass, 8–11 micron, 165–550 tex with about 170–600 ends per meter. An alternative weft yarn includes continuous volumized e-glass or c-glass of 8–11 micron, 165–550 tex with about 170–600 ends per meter. Relatively flat woven surfaces are preferred, with minimal relief.

The present invention is also applicable to nonwoven glass fabrics, such as those mat products produced, for example, by conventional wet-laid processes described in U.S. Pat. Nos. 4,112,174; 4,681,802 and 4,810,576, the disclosures of which are incorporated herein by reference.

In the process of the present invention, the glass fabric 1, preferably in roll form, is fed to an impregnation bath, typically through rollers 3 and conventional conveyance means, to contact a bath of hydrophilic chemical mixture, or alternatively, for example, a pick up roll may convey the hydrophilic chemicals to at least one of the glass fabric surfaces. By the term "hydrophilic" it is meant a chemical or chemical mixture having an infinity for, attracting, adsorbing, or absorbing water. A preferred hydrophilic coating mixture consists of those components set out in Table 1 below.

TABLE 1

| | |
|---|---|
| Potato Starch | 65–75% of dry substance |
| Vinyl acetate ethylene copolymer | 20–30% dry substance |
| Ammonium zirconium carbonate | 2–6% of dry substance |

The mixture is preferably water based, and has a dry substance percentage of between 3 and 10 weight percent, preferably between about 5.5 and 8 weight percent in the chemical bath.

Following impregnation, the fabric may be conveyed to a drying means 4, which in the preferred embodiment of FIG. 1 is depicted as steam heated cylinders 5. After drying, the weave is usually cut into desired width, and collected for subsequent secondary treatment, for example, into rolls at a batching stand 6 of between 1,000 and 6,000 meters of treated weave. Alternatively, the subsequent image application step can be a continuous and direct step to the impregnation step.

Figure 2:
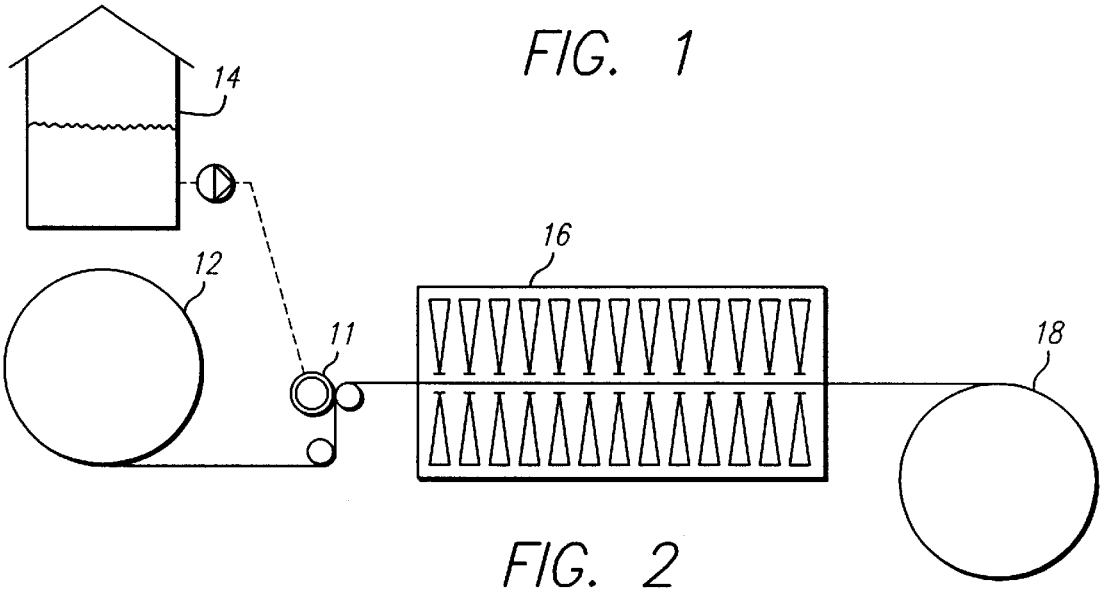
FIG. 2 depicts a method of applying the secondary image coating by a rotating screen.

In FIG. 2, a preferred method of applying the image coating is depicted. A rotating screen 11, such as available from Stork, may be used to selectively apply a hydrophobic secondary image coating to a select portion of the treated glass fabric 12. The rotating screen is preferably laser drilled with a desired image pattern, and chemicals supplied to the interior of the rotating screen. Hydrophobic chemicals 14 are selectively applied to the glass fabric by contact with the rotating screen device. By "hydrophobic", it is meant a chemical or chemical mixture lacking an infinity for, repelling, or failing to adsorb or absorb water. A preferred hydrophobic mixture useful in the secondary image coating of the present invention, includes a varnish, preferably a clear varnish comprising about 50 dry weight percent vinyl acetate ethylene copolymer. Alternatively, the hydrophobic mixture may be any varnish with or without color pigments. Water based paints, or non water based paints, i.e. metallic paints, are also useful image coatings. When a clear varnish is used, it is preferable to apply an optical whitener for a quality checking ability, whereby the varnish is visible to an ultraviolet observation. The varnishes or paints used, should be hydrophobic when dry. Thickener may be added to the hydrophobic mixtures for processability.

Alternatively to the rotating screen employed in the preferred embodiment, the hydrophobic image chemicals may be applied by a flat screen method, or any other method to selectively place the chemicals on the treated glass fiber surface. Following chemical applications, the glass fabric, now possessing an image coating, is preferably stabilized in a drying process using a "spann rahm", whereby the woven material is "fixed" through aggressive mechanical contacting during drying in the dryer, preferably an air dryer oven 16. The fixing of the weave stabilizes the dimensions of the fabric. Following stabilization and drying, the glass fabric is then preferably cut into desired widths and lengths, and collected in a roll at a batching stand 18.

Figure 3A:
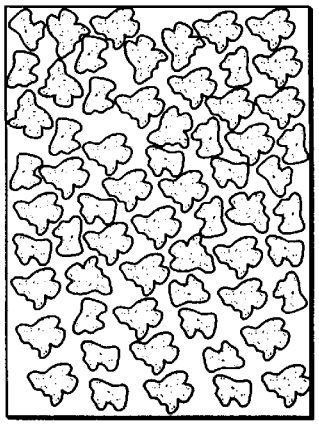
FIG. 3 depicts various finished images made by application of a secondary image coating to a select portion of treated glass fabric.
Figure 3B:
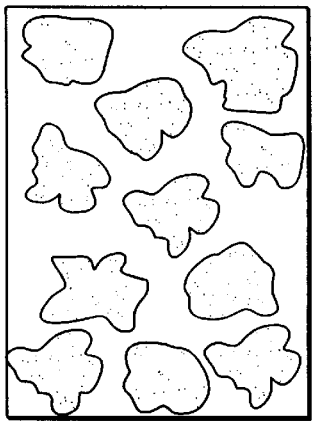
Figure 3C:
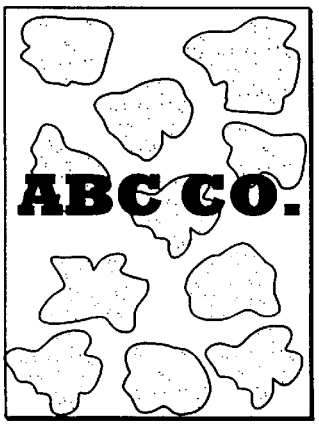

The product of the novel process described above is typically supplied to an end user in roll form, for application to a wall or other interior structure. FIG. 3 depicts examples of the finished image produced following painting of the treated glass fiber wallcovering of the present invention. Typically, a water based glue system is used to apply the treated glass fabric to the wall. The product of the present invention possesses the same benefits and favorable properties as untreated standard glass fiber wallcovering, with the added benefit of producing paint effects in a user selected color, in a minimal labor intensive process. The product is also beneficial to professional painters, due to a reduced time requirement for producing a finished painted application. The design effect glass wallcovering of the present invention results in a higher quality and more consistent outcome, relative to other painting methods, particularly in small spaces and interior comers.

The foregoing description of the specific preferred embodiments will fully reveal the general nature of the present invention that others can readily modify or adapt for various applications to such specific embodiments, without departing from the novel generic concept, and therefore such adaptations and modifications would and are intended to be within the scope of equivalents of the disclosed embodiments. The phraseology and terms employed herein are for the purpose of enablement and description and do not limit the scope of the claims.

What is claimed is:

1. Process of manufacturing a designed fiberglass wallcovering comprising the steps of providing a fiberglass fabric; impregnating the glass fabric with a hydrophilic agent; drying the glass fabric; and subsequently, selectively applying a hydrophobic image coating to a portion of the glass fabric, to thereby provide a fabric with selected areas that are more resistant than nonselected areas to adsorbents of a final coating.

2. The process of claim 1 wherein the fiberglass fabric is a woven fabric in rolled form.

3. The process of claim 1 wherein the fiberglass fabric is a nonwoven in rolled form.

4. The process of claim 1 wherein the hydrophilic agent is applied in a continuous impregnation process.

5. The process of claim 1 wherein the hydrophilic agent comprises vinyl acetate ethylene copolymer.

6. The process of claim 5 wherein the hydrophilic agent comprises a mixture of potato starch, vinyl acetate ethylene copolymer, and ammonium zirconium carbonate.

7. The process of claim 6 wherein the potato starch comprises 65–75%, the vinyl acetate ethylene copolymer 20–30%, and ammonium zirconium carbonate 2–6% of dry substance total, further wherein the coating is water based and has a dry substance percentage in the chemical bath of between 3 and 10 weight percent.

8. The process of claim 1 wherein the drying of the glass fabric is accomplished in an air dryer.

9. The process of claim 1 wherein the air dryer further comprises means for fixing the glass fiber fabric through mechanical contacting in a spann rahm.

10. The process of claim 1 wherein the selective applying of hydrophobic coating is accomplished with a rotating screen applicator.

11. The process of claim 1 wherein the hydrophobic secondary image coating comprises a varnish.

12. The process of claim 11 wherein the varnish comprises between 30–60 dry weight percent vinyl acetate ethylene copolymer.

13. The process of claim 11 wherein the varnish further comprises coloring pigments.

14. The process of claim 1 wherein the hydrophobic secondary image comprises a paint.

15. The process of claim 14 wherein the paint is a water based paint.

16. The process of claim 14 wherein the paint is a metallic paint.

* * * * *